US009038576B2

(12) United States Patent
Neumeier et al.

(10) Patent No.: US 9,038,576 B2
(45) Date of Patent: May 26, 2015

(54) ULTRA LOW NOX BURNER USING DISTRIBUTED DIRECT FUEL INJECTION

(71) Applicants: Yedidia Neumeier, Atlanta, GA (US); David S. Neff, Johns Creek, GA (US); Michael Pratte, Murryville, GA (US)

(72) Inventors: Yedidia Neumeier, Atlanta, GA (US); David S. Neff, Johns Creek, GA (US); Michael Pratte, Murryville, GA (US)

(73) Assignee: Plum Combustion, Inc., Atlanta, GA (US)

( * ) Notice: Subject to any disclaimer, the term of this patent is extended or adjusted under 35 U.S.C. 154(b) by 204 days.

(21) Appl. No.: 13/899,960

(22) Filed: May 22, 2013

(65) Prior Publication Data

US 2014/0345541 A1 Nov. 27, 2014

(51) Int. Cl.

| | |
|---|---|
| ***F24H 1/00*** | (2006.01) |
| ***F23D 14/70*** | (2006.01) |
| ***F23D 14/02*** | (2006.01) |
| ***F24H 1/18*** | (2006.01) |

(52) U.S. Cl.

CPC ..... *F23D 14/70* (2013.01); *F23D 14/02* (2013.01); *F24H 1/186* (2013.01)

(58) Field of Classification Search

CPC ..... F24H 9/1836; F24H 1/186; F24H 1/205; F24H 9/06; F23C 5/02

USPC ..... 122/13.01, 13.3, 17.1, 17.2; 431/7, 8

See application file for complete search history.

(56) References Cited

U.S. PATENT DOCUMENTS

| | | | | |
|---|---|---|---|---|
| 4,411,617 | A * | 10/1983 | Maksim, Jr. | 431/187 |
| 5,066,219 | A * | 11/1991 | Anzawa et al. | 431/10 |
| 5,073,105 | A | 12/1991 | Martin et al. | |
| 5,199,355 | A | 4/1993 | Larue | |
| 5,201,650 | A | 4/1993 | Johnson | |
| 5,240,411 | A | 8/1993 | Abalos | |
| 5,435,716 | A * | 7/1995 | Joyce | 431/7 |
| 5,470,222 | A * | 11/1995 | Holowczak et al. | 431/7 |
| 5,667,376 | A | 9/1997 | Robertson et al. | |
| 5,743,727 | A | 4/1998 | Rodgers | |
| 5,749,356 | A | 5/1998 | Mandeville et al. | |
| 5,846,067 | A | 12/1998 | Nishiyama et al. | |
| 5,988,116 | A | 11/1999 | Vago et al. | |
| 6,435,140 | B1 * | 8/2002 | Joyce | 122/13.01 |
| 6,446,581 | B1 | 9/2002 | Carbone et al. | |
| 6,508,207 | B2 | 1/2003 | Shellenberger et al. | |

(Continued)

OTHER PUBLICATIONS

Cleveland Wire Cloth & Manufacturing Company: "Woven Wire Cloth—Specifications and Technical Information" Dec. 3, 2011.

(Continued)

*Primary Examiner* — Gregory A Wilson

(74) *Attorney, Agent, or Firm* — Bryan W. Bockhop; Bockhop & Associates, LLC

(57) ABSTRACT

A burner box includes a housing, a fuel tube and a porous heat dissipating surface. The housing is bounded by a sidewall and has a top and an opposite bottom that are each open so that the sidewall defines an open passage that allows unimpeded vertical airflow. The fuel tube extends into the passage and defines a plurality of spaced apart orifices that distribute fuel into the open passage. The fuel tube is at a distance from the top of the housing so that substantially all of the fuel is entrained by the combustion air before the fuel reaches the top. The heat dissipating surface is disposed across the top of the housing and supports a flame. The heat dissipating surface includes enough open area so that the fuel/air mixture passes through the porous heat dissipating surface unimpeded. The heat dissipating surface dissipates heat from the flame and prevents flashback.

24 Claims, 4 Drawing Sheets

(56) References Cited

U.S. PATENT DOCUMENTS

| | | | | |
|---|---|---|---|---|
| 6,698,385 | B1 * | 3/2004 | Lesage | 122/13.01 |
| 6,725,811 | B1 * | 4/2004 | Moore et al. | 122/13.01 |
| 6,761,134 | B1 | 7/2004 | Trant | |
| 6,994,056 | B1 | 2/2006 | Boros | |
| 7,040,258 | B2 * | 5/2006 | Peart et al. | 122/13.01 |
| 7,665,426 | B2 * | 2/2010 | O'Donnell et al. | 122/17.1 |
| 7,857,617 | B2 | 12/2010 | O'Donnell et al. | |
| 8,292,616 | B2 | 10/2012 | O'Donnell et al. | |
| 2001/0010209 | A1 | 8/2001 | Bourke et al. | |
| 2007/0221142 | A1 | 9/2007 | Garrabrant et al. | |
| 2007/0254251 | A1 | 11/2007 | Cao et al. | |
| 2009/0220899 | A1 | 9/2009 | Sangelo et al. | |
| 2010/0104989 | A1 * | 4/2010 | Assmann et al. | 431/7 |
| 2010/0154723 | A1 | 6/2010 | Garrabrant et al. | |
| 2011/0244405 | A1 | 10/2011 | Hucsko et al. | |
| 2012/0037146 | A1 | 2/2012 | Platvoet | |
| 2013/0059257 | A1 * | 3/2013 | O'Donnell et al. | 431/329 |

OTHER PUBLICATIONS

ISA: "Notification of Transmittal of the International Search Report and the Written Opinion of the International Searching Authority, or the Declaration" mailed Sep. 10, 2014.

* cited by examiner

ULTRA LOW NOX BURNER USING DISTRIBUTED DIRECT FUEL INJECTION

BACKGROUND OF THE INVENTION

1. Field of the Invention

The present invention relates to fuel burners and, more specifically, to a burner that produces low NOx levels.

2. Description of the Related Art

Water heaters employ burners to heat water in a tank. Many existing burners generate high temperature flames that cause nitrogen to react with oxygen in the combustion air so as to form mono-nitrogen oxides (referred to as "NOx"), which are pollutants. Some burners employ configurations to reduce heat concentration of the flame, thereby reducing the flame temperature and, thus, reducing the amount of NOx produced during combustion. Many such burners employ complicated systems for combining fuel and combustion air. More specifically, heating systems for natural draft water heaters are more problematic by nature as the flue has very limited draft forcing. The needs for low NOx systems further complicate the situation. Until recently only limited firing capacity could be achieved by low NOx burners that are not fan assisted.

Therefore, there is a need for a simple combustion system that produces low NOx levels during combustion.

SUMMARY OF THE INVENTION

The present invention is directed to extending the power of low NOx high efficiency natural draft thermal systems.

The disadvantages of the prior art are overcome by the present invention which, in one aspect, is a burner box that includes a housing, a fuel tube and a porous heat dissipating surface. The housing is bounded by at least one sidewall and has a top and an opposite bottom. The top and the bottom are each open so that the sidewall defines an open passage that is configured to allow substantially unimpeded vertical convective airflow upwardly from the bottom and so that 100% of all combustion air flows upwardly from the open bottom. The fuel tube extends into the passage defined by the housing. The fuel tube has an inner cavity that is confined by a tube wall and that is in fluid communication with a fuel connection port outside of the housing. The tube wall includes a plurality of spaced apart orifices passing therethrough that are configured to distribute fuel received through the fuel connection into the open passage defined by the sidewall of the housing. The fuel tube is disposed at a distance from the top of the housing so that substantially all of the fuel distributed from the fuel tube is entrained by the combustion air before the fuel reaches the top of the housing, thereby forming a substantially homogenous fuel/air mixture. The porous heat dissipating surface is disposed across the top of the housing. The porous heat dissipating surface is configured to support a flame resulting from combustion of the fuel/air mixture. The porous heat dissipating surface includes enough open area so that the fuel/air mixture passes through the porous heat dissipating surface substantially unimpeded. The porous heat dissipating surface is configured to dissipate heat from the flame mostly by radiation into the surroundings and thus also serves to prevent flashback of the flame into the housing.

In another aspect, the invention is a water heater that includes a water tank, a combustion space and a burner box assembly. The water tank is configured to hold water therein and has a bottom surface. The water tank defines a flue passing upwardly therethrough. The combustion space is surrounded by an outer wall and is bound by the bottom surface of the water tank so that the combustion space is disposed beneath the bottom surface of the water tank. The combustion space is in fluid communication with the flue. The combustion space has a bottom area configured to allow air to pass upwardly therethrough substantially unimpeded. The burner box assembly is disposed in the combustion space and includes a burner box. The burner box includes a housing, a fuel tube and a porous heat dissipating surface. The burner box assembly is configured to support a flame so as to heat water in the water tank through the bottom surface of the water tank and the flue.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1A:
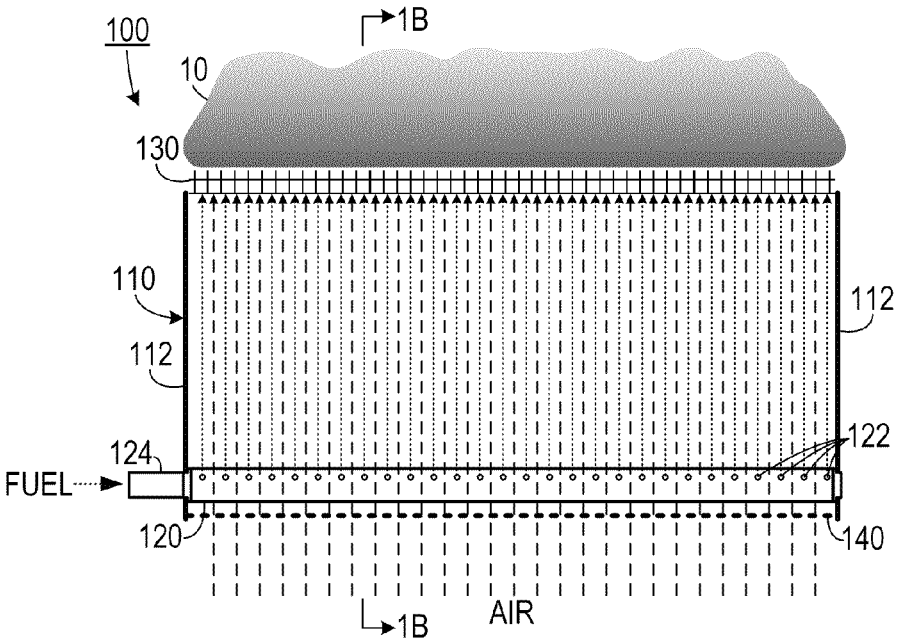
FIG. 1A is a side schematic view of a burner box.
Figure 1B:
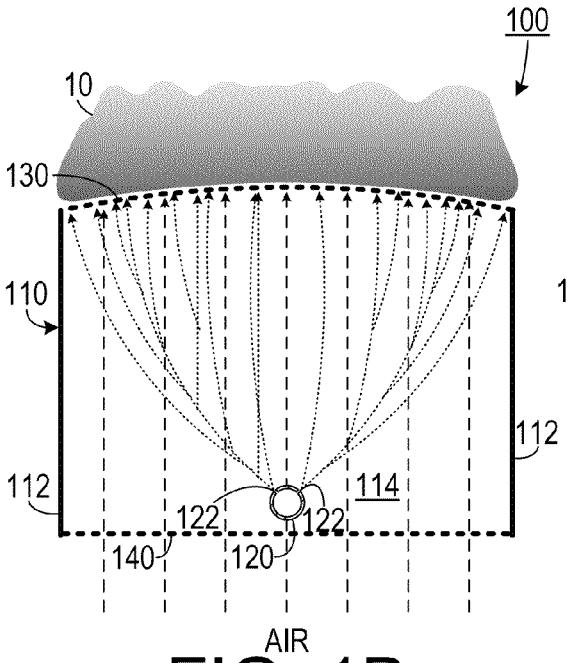
FIG. 1B is a cross schematic view of the burner box shown in FIG. 1A, taken along line 1B-1B.
Figure 1C:
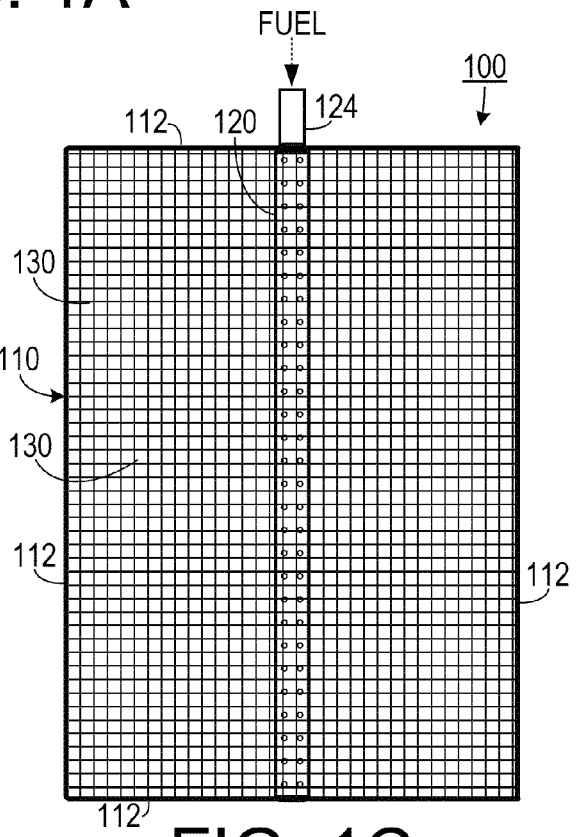
FIG. 1C is a top schematic view of the burner box shown in FIG. 1A.
Figure 1D:
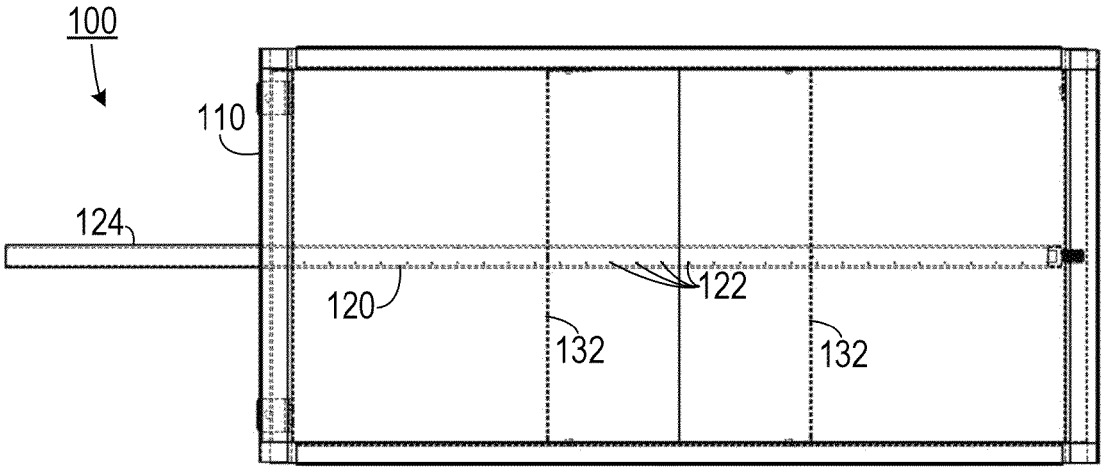
FIG. 1D is a top plan view of a burner box.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on."

As shown in FIGS. 1A-1D, one embodiment of a burner box 100 includes a housing 110 that is bounded by at least one sidewall 112 (the embodiment shown is rectangular, with four sidewalls 112) that defines a passage 114. The top and the bottom of the housing 110 are substantially open so as to allow air to move freely upwardly through the passage 114. A fuel tube 120 extends into the passage 114. The fuel tube 120 is in fluid communication with a fuel port 124 that is outside the housing 110. The fuel tube 120 includes a plurality of spaced apart orifices 122 that distribute fuel (e.g., natural gas, etc.) received from the fuel port 124 into the passage 114. In the embodiment shown, the fuel tube 120 is straight and the orifices 122 are evenly spaced apart along two spaced apart rows that run the length of the tube 120. The fuel tube 120 extends through one of the walls 112 and is affixed to an opposite one of the walls 112 so as to hold the fuel tube in 120 an alignment that results in fuel injection in a substantially upward direction. Also, in one embodiment, the total orifices injection area ranges from 20% to 50% of the cross-sectional area of the fuel tube 120. The fuel tube 120 is placed at a distance from the top of the housing 110 so that substantially all of the fuel distributed from the fuel tube is entrained by combustion air flowing upwardly through the passage 114 before the fuel reaches the top of the housing 110. This results in a substantially homogenous fuel/air mixture near the top of the housing 110. The housing 110 has dimensions such that 100% of all combustion air flows upwardly from the open bottom of the housing 110, without any requirement for combustion air to be brought in through the side.

A metal mesh 130 (or other type of porous heat dissipating surface, such as a ceramic material) is disposed across the top of the housing 110. The mesh 130 supports a flame 10 that results from combustion of the fuel/air mixture. The mesh 130 includes enough open area so that the fuel/air mixture passes through the mesh 130 substantially unimpeded. In one embodiment, the mesh 130 is a low resistance mesh having at least a 65% open area and can include a 24×24 mesh with a 0.0075 inch diameter wire. The mesh 130 dissipates heat from the flame 10 and prevents flashback of the flame 10 into the housing 110. One embodiment may also include one or more supports 132 that maintain the metal mesh 130 with an upwardly curved shape, thereby increasing the surface area of the mesh 132. An optional mesh 140 may be included adjacent to the bottom of the housing 110 as a flame arrestor to prevent flame from the burner from reaching the bottom and to prevent external fire from entering the housing 110.

Distributing the fuel injection along the entire length of the fuel tube 120 into the upwardly flowing combustion through the entire height of the housing 110 results in substantially all of the fuel being entrained in the combustion air once it reaches the mesh 130. This results in a lower combustion temperature, which results in reduced NOx generation as a result of the combustion.

Figure 2A:
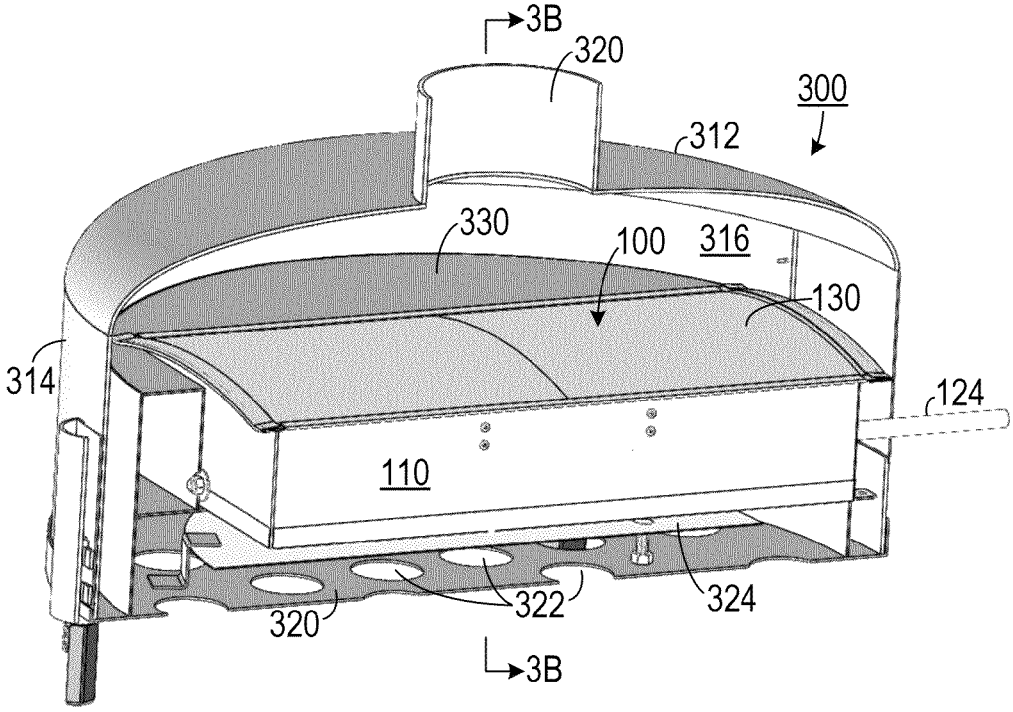
FIG. 2A is a perspective view of an opened water heater.
Figure 2B:
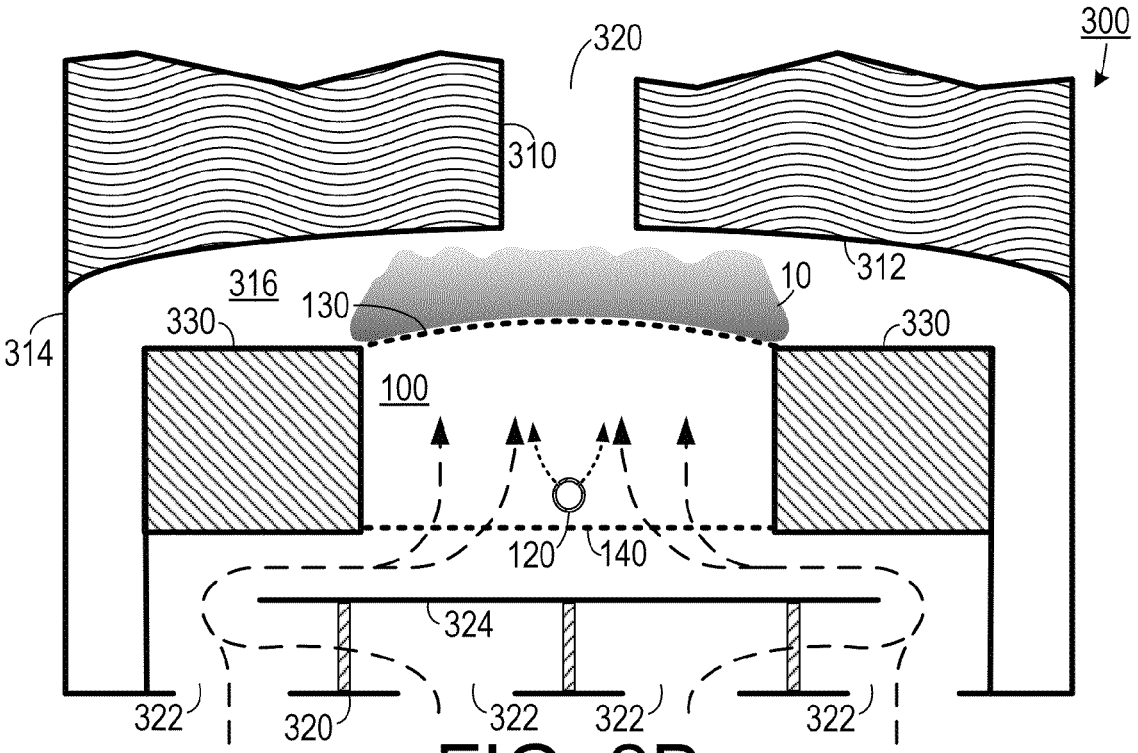
FIG. 2B is a schematic cross sectional view of a water heater of the type shown in FIG. 2A.
Figure 2C:
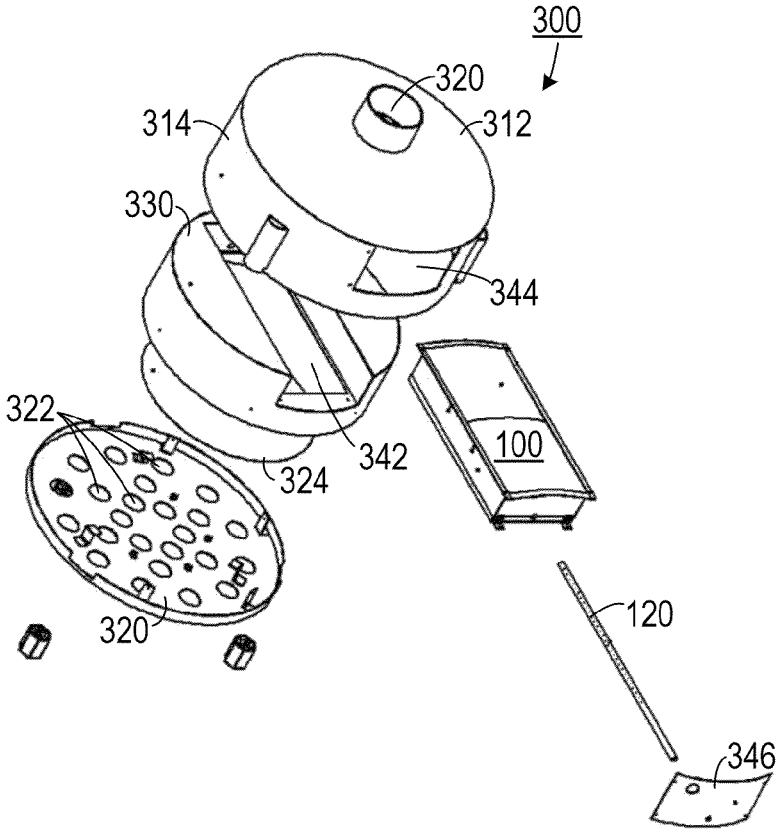
FIG. 2C is an exploded view of the water heater shown in FIG. 2A.

As shown in FIGS. 2A-2C, a burner box 100 of the type disclosed above can be employed as part of a water heater 300 that includes a water tank 310 that has a bottom surface 312 and that has a flue 320 passing upwardly therethrough. Some embodiments may include additional baffles and heat transfer surfaces coupled to the flue 320. A combustion space 316 is defined between an outer wall 314 and the bottom surface 312 of the water tank 310. The flame 10 is supported in the combustion space 316 on the mesh 130 and provides heat to the bottom surface 312 and to the surface of the flue 320, thereby heating the water in the tank 310.

A base 320 that includes a plurality of holes 322 is disposed under the burner box 100 and allows air to pass freely upwardly therethrough. A radiation shield plate 324 is placed between the bottom of the burner box 100 and the base 320 to prevent heat from the burner box 100 from harming the floor beneath the water heater 300. An optional mesh 140 may be included as a flame arrestor to prevent flame from the burner to reach to the bottom and to prevent external fire from entering.

A plenum 330 may be disposed within the combustion space 316 and around the burner box 100 so as to separate it from the bottom of the water heater 300. In one embodiment, the plenum 330 has at least one outer dimension so that thermal acoustic noise is substantially reduced in the combustion space 316, resulting in a quiet operation. The plenum 330 defines a compartment 342 into which the burner box 100 fits. An opening in the outer wall 314 allows access to the burner box 100 and a curved plate 346 isolates the combustion space 316 from outside of the water heater 300.

Figure 3:
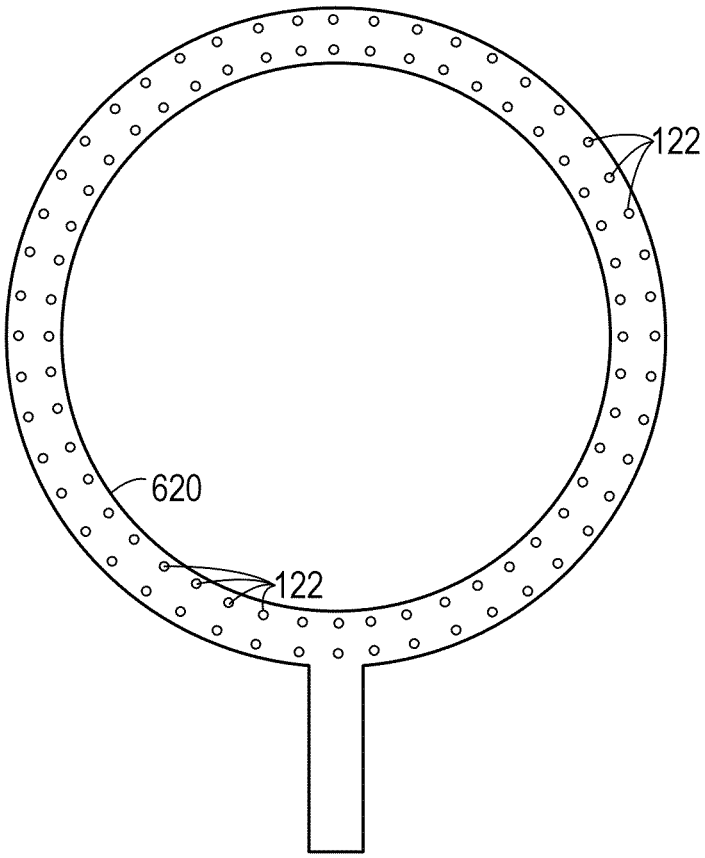
FIG. 3 is a top plan view of one embodiment of a fuel tube.

Many different shapes for the fuel tube are possible without departing from the scope of the invention. For example, in one embodiment, as shown in FIG. 3, the fuel tube 620 can have a circular shape. In other embodiments, for example, the fuel tube may be semicircular, or include two spaced-apart semicircular halves connected to a central coupling.

While a water heater is disclosed herein, it should be understood that other fluids may be heated with a burner box of the type disclosed above without departing from the scope of the invention.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A burner box, comprising:

(a) a housing bounded by at least one sidewall, the housing having a top and an opposite bottom, the top and the bottom each open so that the sidewall defines an open passage that is configured to allow substantially unimpeded vertical convective airflow upwardly from the bottom so that 100% of all combustion air flows upwardly from the open bottom; and (b) a fuel tube extending into the passage defined by housing, the fuel tube having an inner cavity that is confined by a tube wall and that is in fluid communication with a fuel connection port outside of the housing, the tube wall defining a plurality of spaced apart orifices passing therethrough that are configured to distribute fuel received through the fuel connection into the open passage defined by the sidewall of the housing, the fuel tube disposed at a distance from the top of the housing so that substantially all of the fuel distributed from the fuel tube is entrained by the combustion air before the fuel reaches the top of the housing, thereby forming a substantially homogenous fuel/air mixture; and (c) a porous heat dissipating surface disposed across the top of the housing, the porous heat dissipating surface configured to support a flame resulting from combustion of the fuel/air mixture, the porous heat dissipating surface including enough open area so that the fuel/air mixture passes through the porous heat dissipating surface substantially unimpeded, the porous heat dissipating surface configured to dissipate heat from the flame and to prevent flashback of the flame into the housing, wherein the fuel tube comprises a straight tube that extends from a first side of the housing to an opposite second side of the housing and wherein the orifices are evenly spaced apart along two spaced apart rows that run the length of the tube.

2. The burner box of claim 1, wherein the fuel tube has a cross-sectional area and wherein the orifices subtend from 20% to 50% of the tube cross-sectional area.

3. The burner box of claim 1, wherein the porous heat dissipating surface comprises a metal mesh.

4. The burner box of claim 3, wherein the mesh is a low resistance mesh having at least a 65% open area.

5. The burner box of claim 3, wherein the mesh is a 24×24 mesh with a 0.0075 inch diameter wire.

6. The burner box of claim 3, further comprising at least one support that is configured to maintain the metal mesh with an upwardly curved shape.

7. The burner box of claim 1, wherein the housing has a rectangular plan shape with a first pair of walls that are separated by a first distance and a second pair of walls that are separated by a second distance, in which the first distance is greater than the second distance and wherein the tube has a length that is substantially the first distance.

8. The burner box of claim 7, wherein a first one of the first pair of walls comprise an opening passing therethrough through which the fuel tube extends, an end of the fuel tube affixed to a second one of the first pair of walls so as to hold the fuel tube in an alignment that results in fuel injection in a substantially upward direction.

9. The burner box of claim 1, further comprising a flame arrestor disposed adjacent to the bottom of the housing.

10. The burner box of claim 9, wherein the flame arrestor comprises a metal mesh.

11. A water heater, comprising:

(a) a water tank configured to hold water therein and having a bottom surface and defining a flue passing upwardly therethrough;

(b) a combustion space surrounded by an outer wall and bound by the bottom surface of the water tank so that the combustion space is disposed beneath the bottom surface of the water tank, the combustion space in fluid communication with the flue, the combustion space having a bottom area configured to allow air to pass upwardly therethrough substantially unimpeded;

(c) a burner box assembly disposed in the combustion space and including:

(i) a housing bounded by at least one sidewall, the housing having a top and an opposite bottom, the top and the bottom each open so that the sidewall defines an open passage that is configured to allow substantially unimpeded vertical convective airflow upwardly from the bottom so that 100% of all combustion air flows upwardly from the open bottom; and (ii) a fuel tube extending into the passage defined by housing, the fuel tube having an inner cavity that is confined by a tube wall and that is in fluid communication with a fuel connection port outside of the housing, the tube wall defining a plurality of spaced apart orifices passing therethrough that are configured to distribute fuel received through the fuel connection into the open passage defined by the sidewall of the housing, the fuel tube disposed at a distance from the top of the housing so that substantially all of the fuel distributed from the fuel tube is entrained by the combustion air before the fuel reaches the top of the housing, thereby forming a substantially homogenous fuel/air mixture; and (iii) a porous heat dissipating surface disposed across the top of the housing, the porous heat dissipating surface configured to support a flame resulting from combustion of the fuel/air mixture, the porous heat dissipating surface including enough open area so that the fuel/air mixture passes through the porous heat dissipating surface substantially unimpeded, the porous heat dissipating surface configured to dissipate heat from the flame and to prevent flashback of the flame into the housing; and (d) a plenum disposed within the combustion space and around the burner box assembly, the plenum having at least one outer dimension configured to interfere with acoustic harmonics in the combustion space, wherein the burner box assembly is configured to support the flame so as to heat water in the water tank through the bottom surface of the water tank and the flue 14, wherein the fuel tube comprises a straight tube that extends from a first side of the housing to an opposite second side of the housing and wherein the orifices are evenly spaced apart along two spaced apart rows that run the length of the tube.

12. The water heater of claim 11, further comprising:

(a) a base disposed under the burner box assembly that is configured to allow air to pass freely upwardly therethrough; and (b) a radiation shield plate configured to shield an area under the water heater from heat generated by the burner box assembly.

13. The water heater of claim 11, wherein the fuel tube has a cross-sectional area and wherein the orifices subtend from 20% to 50% of the tube cross-sectional area.

14. The water heater of claim 11, wherein the porous heat dissipating surface comprises a metal mesh.

15. The water heater of claim 14, wherein the mesh is a low resistance mesh having at least a 65% open area.

16. The water heater of claim 14, wherein the mesh is a 24×24 mesh with a 0.0075 inch diameter wire.

17. The water heater of claim 14, further comprising at least one support that is configured to maintain the metal mesh with an upwardly curved shape.

18. The water heater of claim 11, wherein the housing has a rectangular plan shape with a first pair of walls that are separated by a first distance and a second pair of walls that are separated by a second distance, in which the first distance is greater than the second distance and wherein the tube has a length that is substantially the first distance and wherein a first one of the first pair of walls comprise an opening passing therethrough through which the fuel tube extends, an end of the fuel tube affixed to a second one of the first pair of walls so as to hold the fuel tube in an alignment that results in fuel injection in a substantially upward direction.

19. The water heater of claim 11, further comprising a flame arrestor including a metal mesh disposed adjacent to the bottom of the housing.

20. A burner box, comprising:

(a) a housing bounded by at least one sidewall, the housing having a top and an opposite bottom, the top and the bottom each open so that the sidewall defines an open passage that is configured to allow substantially unimpeded vertical convective airflow upwardly from the bottom so that 100% of all combustion air flows upwardly from the open bottom; and (b) a fuel tube extending into the passage defined by housing, the fuel tube having an inner cavity that is confined by a tube wall and that is in fluid communication with a fuel connection port outside of the housing, the tube wall defining a plurality of spaced apart orifices passing therethrough that are configured to distribute fuel received through the fuel connection into the open passage defined by the sidewall of the housing, the fuel tube disposed at a distance from the top of the housing so that substantially all of the fuel distributed from the fuel tube is entrained by the combustion air before the fuel reaches the top of the housing, thereby forming a substantially homogenous fuel/air mixture; and (c) a porous heat dissipating surface disposed across the top of the housing, the porous heat dissipating surface configured to support a flame resulting from combustion of the fuel/air mixture, the porous heat dissipating surface including enough open area so that the fuel/air mixture passes through the porous heat dissipating surface substantially unimpeded, the porous heat dissipating surface configured to dissipate heat from the flame and to prevent flashback of the flame into the housing, wherein the housing has a rectangular plan shape with a first pair of walls that are separated by a first distance and a second pair of walls that are separated by a second distance, in which the first distance is greater than the second distance and wherein the tube has a length that is substantially the first distance, and wherein a first one of the first pair of walls comprise an opening passing therethrough through which the fuel tube extends, an end of the fuel tube affixed to a second one of the first pair of walls so as to hold the fuel tube in an alignment that results in fuel injection in a substantially upward direction.

21. The burner box of claim 20, wherein the fuel tube has a cross-sectional area and wherein the orifices subtend from 20% to 50% of the tube cross-sectional area.

22. The burner box of claim 20, wherein the porous heat dissipating surface comprises a metal mesh.

23. The burner box of claim 22, wherein the mesh is a 24×24 mesh with a 0.0075 inch diameter wire.

24. The burner box of claim 20, wherein the fuel tube is bent into a shape that is a selected one of circular or semicircular.

* * * * *